US007032845B2

(12) United States Patent
Dantes et al.

(10) Patent No.: US 7,032,845 B2
(45) Date of Patent: Apr. 25, 2006

(54) FUEL INJECTION VALVE

(75) Inventors: Guenter Dantes, Eberdingen (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/475,968

(22) PCT Filed: Dec. 23, 2002

(86) PCT No.: PCT/DE02/04736

§ 371 (c)(1),
(2), (4) Date: Apr. 6, 2004

(87) PCT Pub. No.: WO03/072931

PCT Pub. Date: Sep. 4, 2003

(65) Prior Publication Data

US 2004/0149839 A1 Aug. 5, 2004

(30) Foreign Application Priority Data

Feb. 26, 2002 (DE) ..... 102 08 223

(51) Int. Cl.
*F02M 61/16* (2006.01)

(52) U.S. Cl. ..... 239/533.12; 239/463; 239/585.5

(58) Field of Classification Search ..... 123/299, 123/294, 305, 445; 239/533.1–533.12, 585.1–585.5, 239/533.2, 463
See application file for complete search history.

(56) References Cited

U.S. PATENT DOCUMENTS

| | | | | |
|---|---|---|---|---|
| 5,299,919 | A | 4/1994 | Paul et al. | |
| 2003/0116651 | A1* | 6/2003 | Heyse | 239/533.12 |

FOREIGN PATENT DOCUMENTS

| | | |
|---|---|---|
| DE | 27 25 135 | 12/1978 |
| DE | 34 32 663 | 3/1985 |
| DE | 195 13 053 | 10/1996 |
| DE | 196 25 059 | 1/1998 |
| DE | 198 43 895 | 3/2000 |
| DE | 199 07 899 | 8/2000 |
| DE | 101 09 345 | 8/2001 |
| JP | 09 250428 | 9/1997 |

* cited by examiner

*Primary Examiner*—Tony M. Argenbright
(74) *Attorney, Agent, or Firm*—Kenyon & Kenyon LLP

(57) ABSTRACT

A fuel injector for the direct injection of fuel into a combustion chamber of an internal combustion engine is provided, which injector includes a valve needle having at its spray-discharge end a valve-closure member, which cooperates with a valve-seat surface formed on a valve-seat member to form a sealing seat. At least one swirl channel is provided in a section of the valve-seat member surrounding the valve needle, and at least one spray-discharge orifice is provided in the valve-seat member. The at least one swirl channel, when viewed through the swirl channel in the flow direction of the fuel, is inclined counter to the spray-discharge direction relative to the center axis of the valve needle.

18 Claims, 2 Drawing Sheets

FUEL INJECTION VALVE

FIELD OF THE INVENTION

The present invention is directed to a fuel injector for an internal combustion engine.

BACKGROUND INFORMATION

Published German patent document DE 196 25 059 discloses a fuel injector having swirl channels (referred to as fuel channels there), which, in their position relative to the axis of the valve needle, are inclined in the direction of the main flow of the fuel. In published German patent document DE 196 25 059, the incline of the swirl channels is used for the injection of a fuel jet directly into the combustion chamber following in the discharge direction, through the swirl chamber disposed downstream from the valve-seat surface in the main-flow direction, and through the spray-discharge orifice. In this context, "directly" means without the jet striking parts of the fuel injector lying downstream from the spray-discharge orifice of the swirl chamber. The objective in this case is to influence the direction, form and the skeining of the emerging fuel cloud.

A disadvantage of the fuel injector known from published German patent document DE 196 25 059 is, in particular, the lack of homogeneity of the produced fuel cloud, which is often undesired, especially in a combustion chamber having a largely symmetrical design, and in gas-exchange devices, ignition devices and injectors arranged largely symmetrically thereto. Furthermore, the swirl generation in the swirl chamber is restricted.

Additional disadvantages result during the manufacture of the swirl channel. In particular, as a result of the fanning out of the laser, the spray-discharge orifice would be damaged by laser drilling in the flow direction of the swirl channel. A so-called lost casting would need to be inserted into the central bore to protect the spray-discharge orifice. The residue left behind in the bore as a result of the lost casting bombardment would have to be removed in an additional production step. Furthermore, such a lost casting is a part that is subject to wear, and it also makes it more difficult to blow off or suction off tiny droplets from the liquefied material produced in the drilling. When laser drilling in another direction, the laser would fan out too much even before reaching the drilling spot, since the laser nozzle from which the laser beam emerges cannot be guided close enough to the drilling site. Furthermore, the angle of the swirl-channel bore cannot be freely moved in the direction of discharge, since the valve-seat surface would then be exposed to the laser beam.

SUMMARY OF THE INVENTION

The fuel injector according to the present invention has advantages that are attributable to a more cost-effective production method, among others. For example, by the arrangement of the swirl channels, which, in the flow direction of the fuel viewed through the swirl channel, are inclined counter to the spray-discharge orifice with respect to the valve-needle axis, it is possible to carry out laser-drilling in the flow direction of the swirl channels, i.e., from the outer circumference of the valve-seat member toward the center, without it becoming necessary to insert a so-called protective form to protect the inner wall of the valve-seat member lying across from the swirl channel in the flow direction, since the emerging laser beam would not strike this oppositely-lying inner wall in its course.

Since such a protective form would leave residue behind on the surfaces of the valve-seat member as a result of the laser bombardment, and the protective form would block the bore end of the swirl-channel bore, it would also be more difficult or impossible for tiny droplets from liquefied material produced in the drilling process to be blown off or suctioned off from the swirl-channel bore during the drilling procedure. Removing this residue after the swirl channel has been produced would involve additional expense. A retroactive internal grinding would cause the formation of undesired burrs at the swirl-channel outlet.

By eliminating the need for a protective form, it is possible to blow off or suction off tiny droplets of produced liquid material during the drilling procedure. Furthermore, the spray-discharge orifice and the swirl channel are able to be produced in a cost-effective manner in one clamping, i.e., one operation.

Since the dimensions of the central bore are too small in fuel injectors to accommodate a laser nozzle, it is practically impossible to drill counter to the swirl-channel flow direction. The bore extension in the direction of the swirl-channel flow also avoids doughnut-shaped accumulations on the swirl-channel outlets, which are produced at the entry points of laser drilling and result in unpredictable variations of the flow coefficients.

In order to be able to place the laser nozzle close enough to the drilling site during the drilling operation, the swirl channels are introduced so far up at the upstream end of the valve-seat member that the laser nozzle does not contact the forms of the valve-seat member that lie downstream.

The diameter of the valve-closure member is preferably larger in the upstream guide section than in the immediately adjacent downstream swirl-chamber region. This is achieved by a diameter step in the valve-closure member. The volume of the swirl chamber is at its greatest near the diameter step, and the volume is kept low by a ring-gap width that gets progressively smaller in the flow direction, the ring-gap width being formed by a section of the valve needle that widens counter to the flow direction, so that a smooth cross-section transition is achieved. In this way, the swirl-chamber volume is minimized and the enclosed fluid mass can be set to rotate with sufficient speed at the beginning of the spray-discharge.

By a tangential component relative to a longitudinal axis of the fuel injector, it is possible to adjust the swirl flow in the swirl chamber in accordance with the desired requirements. However, there exists a radial directional component with respect to the inner wall of the central bore, so that damage to the inner wall during the drilling of the swirl channel due to manufacturing tolerances is avoided.

The cross-section forms of the swirl channels may have any desired shape. They may be circular, but also elliptical, square, rectangular, triangular, polygonal or trapezoid.

DETAILED DESCRIPTION

Figure 1:
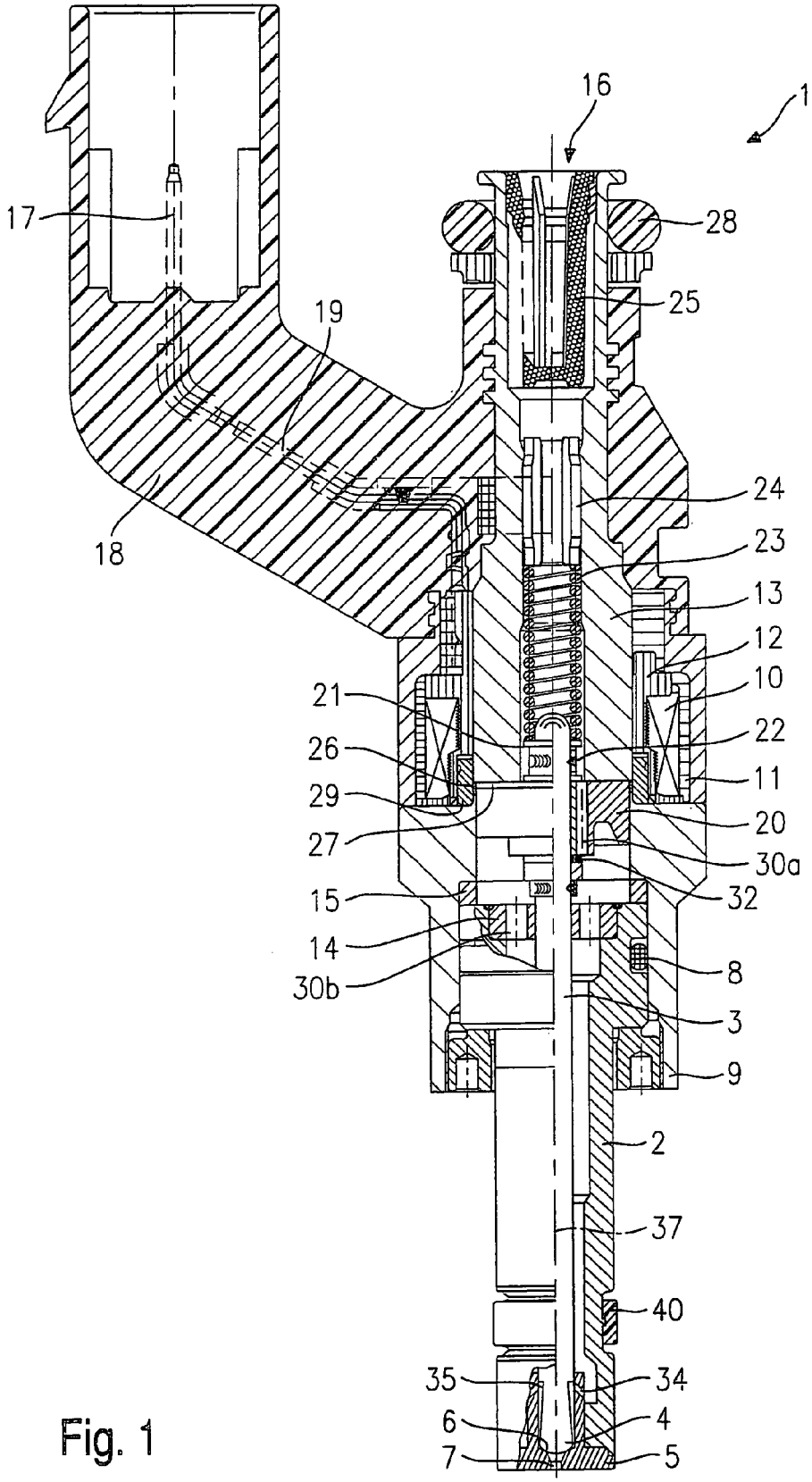
FIG. 1 is a sectional view showing an exemplary embodiment of a fuel injector configured according to the present invention.

The first exemplary embodiment of a fuel injector 1 according to the present invention, shown in FIG. 1, is configured for fuel-injection systems of mixture-compressing internal combustion engines having externally supplied ignition. Fuel injector 1 is suited, for example, for the direct injection of fuel into a combustion chamber (not shown) of an internal combustion engine.

Fuel injector 1 is made up of a nozzle body 2 in which a valve needle 3 is positioned. Valve needle 3 is in operative connection with a valve-closure member 4, which cooperates with a valve-seat surface 6 positioned on a valve-seat member 5 to form a sealing seat. Fuel injector 1 in the exemplary embodiment is an inwardly opening fuel injector. Nozzle body 2 is sealed from outer pole 9 of a magnetic coil 10 by a seal 8. Magnetic coil 10 is encapsulated in a coil housing 11 and wound on a coil brace 12, which rests against an inner pole 13 of magnetic coil 10. Inner pole 13 and outer pole 9 are separated from one another by a gap 26 and are braced against a connecting member 29. Magnetic coil 10 is energized via a line 19 by an electric current, which may be supplied via an electrical plug contact 17. A plastic extrusion coat 18, which may be extruded onto inner pole 13, encloses plug contact 17.

Valve needle 3 is guided in a valve-needle guide 14, which is disk-shaped. A paired adjustment disk 15 is used to adjust the (valve) lift. On the other side of adjustment disk 15 is an armature 20 which, via a first flange 21, is connected by force-locking to valve needle 3, which in turn is joined to first flange 21 by a welding seam 22. Braced on first flange 21 is a restoring spring 23, which is prestressed by a sleeve 24.

A second flange 31, which is connected to valve needle 3 via a welded seam 33, is used as lower armature stop. An elastic intermediate ring 32 resting on second flange 31 prevents rebounding when fuel injector 1 is closed.

Fuel channels 30*b* and 30*a* run in valve-needle guide 14 and in armature 20, respectively. The fuel is supplied via a central fuel supply 16 and filtered by a filter element 25. Swirl channels 34 are provided in valve-seat member 5 both for conveying the fuel and also for swirl generation. Fuel injector 1 is sealed from a fuel line (not shown further) by a seal 28 and from a cylinder head (not shown) by a seal 40.

In the rest state of fuel injector 1, armature 20 is acted on by restoring spring 23, in a direction opposite to its lift direction, in such a manner that valve-closure member 4 is sealingly held against valve seat surface 6. In response to excitation of magnetic coil 10, it generates a magnetic field that moves armature 20 in the lift direction, counter to the spring force of restoring spring 23, the lift being predefined by a working gap 27 that occurs in the rest position between inner pole 12 and armature 20. Flange 21, which is welded to valve needle 3, is taken along by armature 20, in the lift direction as well.

Valve-closure member 4, being operatively connected to valve needle 3, lifts off from valve seat surface 6, and fuel conveyed via swirl channels 34 in valve-seat member 5 is spray-discharged.

If the coil current is switched off, armature 20 falls away from inner pole 13 after sufficient decay of the magnetic field, due to the pressure of restoring spring 23, whereupon flange 21, which is mechanically linked to valve needle 3, moves in a direction counter to the lift direction. Valve needle 3 is thereby moved in the same direction, causing valve-closure member 4 to set down on valve seat surface 6 and fuel injector 1 to be closed.

Figure 2:
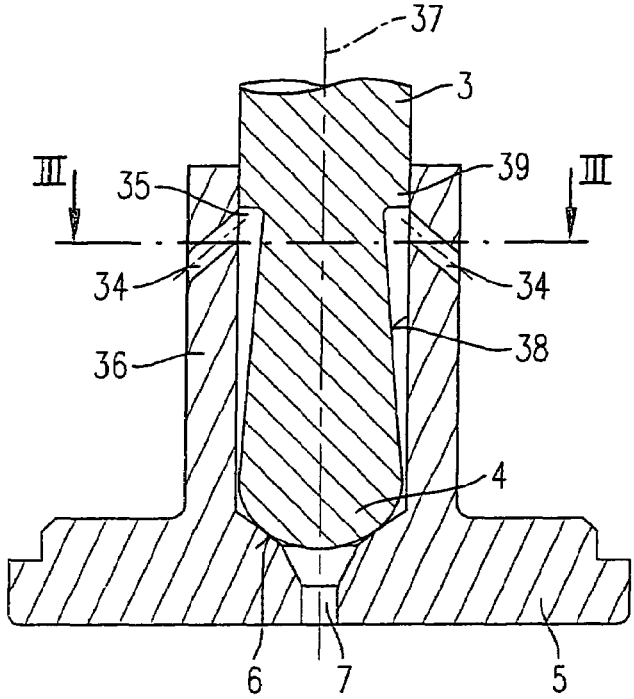
FIG. 2 is a sectional view showing a region of the valve-seat member of the exemplary embodiment of a fuel injector according to the present invention as shown in FIG. 1.

The discharge-side end of fuel injector 1 according to the present invention shown in FIG. 1, also shown in an enlarged and part-sectional view in FIG. 2, includes a valve-seat member 5, which has at least one swirl channel 34. Identical parts are provided with the same reference numerals in all of the figures. Formed between valve-seat member 5 and valve-closure member 4 is a swirl chamber 35, which in the exemplary embodiment tapers in the flow direction, the taper being formed by a section 38 of valve needle 3 that widens in the direction of flow. The volume of swirl chamber 35 is preferably dimensioned such that the dead volume is minimal and a circumferentially directed swirl flow may form when fuel flows into swirl chamber 35. Viewed in the direction of flow, swirl chamber 35 is delimited at the upstream end by a diameter step 39 of valve needle 3, and at the downstream end by the setting down of valve-closure member 4 on valve-seat member 5. Swirl chamber 35 has the greatest volume in the region of the inlet of swirl channels 34.

When extending the drawn-in axial axes of symmetry of swirl channels 34, it becomes apparent that swirl channels 34 are tilted relative to the center axis of valve needle 3 to such a degree that said extension does not meet components of valve-seat member 5. This has decisive advantages in the manufacture of fuel injector 1. For instance, when producing the swirl channels in valve-seat member 5, e.g., during laser drilling from radially outside toward radially inside, it is possible to dispense with a protective form, which would otherwise be needed to protect the inside of valve-seat member 5. Dispensing with the protective form has additional advantages. For example, reworking steps to remove deposits adhering to valve-seat member 5 as a result of the bombardment of the protective form then become unnecessary. Furthermore, dispensing with the protective form substantially facilitates the blowing off or suctioning off of slag and melted material from swirl channel 34 when the swirl-channel is produced by laser drilling, especially since the protective form would otherwise block the produced orifice of the inner swirl-channel end, and thus no cleaning flow through swirl channel 34 could be generated.

Figure 3:
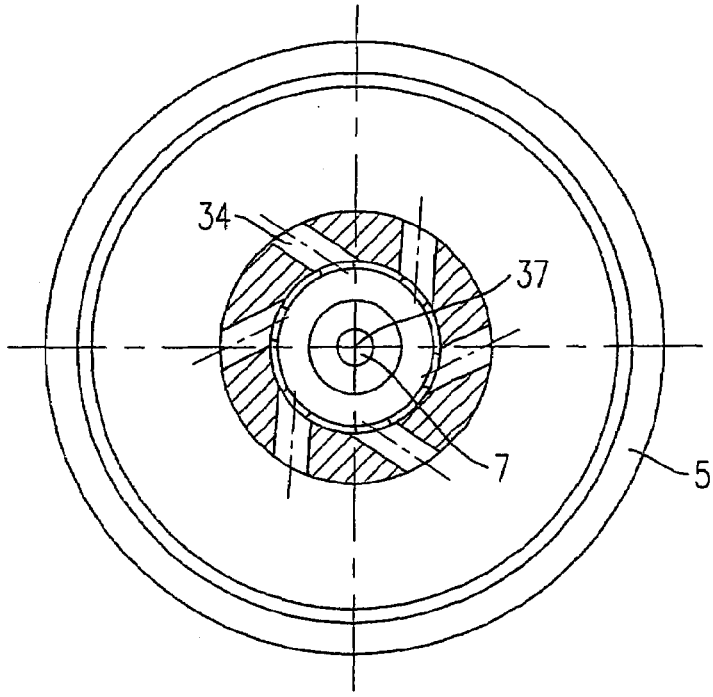
FIG. 3 is a sectional view showing the valve-seat member along line III—III shown in FIG. 2.

In FIG. 3, which is a sectional view showing a section through the exemplary embodiment of fuel injector 1 according to the present invention shown in FIG. 2, taken along the line III—III in FIG. 2, due to a tangential component of swirl channel 34 relative to center axis 37 of valve needle 3 of fuel injector 1, fuel does not enter swirl chamber 35, formed between valve-seat member 5 and valve-closure member 4, in a directly radial manner, thereby allowing a swirl flow to form that is directed in the circumferential direction. The velocity of the swirl flow is increased in the spray-discharge direction by tapering swirl chamber 35, so that the fuel spray-discharged through spray-discharge orifice 7 produces a homogenous and symmetrical fuel cloud.

The present direction is not restricted to the exemplary embodiment shown, but applicable, for example, to a variety of designs of fuel injectors, for example to outwardly opening fuel injectors.

What is claimed is:

1. A fuel injector for direct injection of fuel into a combustion chamber of an internal combustion engine, comprising:

a valve-seat member having a valve-seat surface;

a valve needle having at its spray-discharge end a valve-closure member, the valve-closure member cooperating with the valve-seat surface on the valve-seat member to form a sealing seat;

at least one swirl channel provided in a section of a valve component surrounding the valve needle;

at least one spray-discharge orifice provided downstream from the sealing seat for spray-discharging the fuel; and a swirl chamber which tapers in a flow direction of fuel within the swirl chamber, the taper being formed by a section of the valve needle that widens in the flow direction of fuel within the swirl chamber;

wherein the swirl channel, when viewed through the swirl channel in a flow direction of the fuel within the swirl channel, is inclined counter to a spray-discharge direction relative to the center axis of the valve needle.

2. The fuel injector as recited in claim 1, wherein the swirl channel is inclined at a selected angle such that a longitudinal axis of the swirl channel does not meet the valve-seat member.

3. The fuel injector as recited in claim 1, wherein at least two swirl channels are provided, the at least two swirl channels having different inclinations with respect to the center axis of the valve needle.

4. The fuel injector as recited in claim 2, wherein at least two swirl channels are provided, the at least two swirl channels having different inclinations with respect to the center axis of the valve needle.

5. The fuel injector as recited in claim 2, wherein the longitudinal axis of the at least one swirl channel is radially offset from the center axis of the valve needle and has a tangential directional component.

6. The fuel injector as recited in claim 4, wherein the longitudinal axes of the at least two swirl channels are radially offset from the center axis of the valve needle and have a tangential directional component.

7. The fuel injector as recited in claim 5, wherein at least two swirl channels are provided, the at least two swirl channels differing in their radial offsets relative to the center axis of the valve needle.

8. The fuel injector as recited in claim 6, wherein the at least two swirl channels differ in their radial offsets relative to the center axis of the valve needle.

9. The fuel injector as recited in claim 1, wherein a plurality of swirl channels are provided, and wherein the swirl channels have different clearances from each other in the circumferential direction relative to the center axis of the valve needle.

10. The fuel injector as recited in claim 2, wherein a plurality of swirl channels are provided, and wherein the swirl channels have different clearances from each other in the circumferential direction relative to the center axis of the valve needle.

11. The fuel injector as recited in claim 5, wherein a plurality of swirl channels are provided, and wherein the swirl channels have different clearances from each other in the circumferential direction relative to the center axis of the valve needle.

12. The fuel injector as recited in claim 1, wherein a swirl chamber is provided upstream from the valve-seat surface, and wherein the at least one swirl channel discharges into the swirl chamber.

13. The fuel injector as recited in claim 2, wherein a swirl chamber is provided upstream from the valve-seat surface, and wherein the at least one swirl channel discharges into the swirl chamber.

14. The fuel injector as recited in claim 1, wherein the section of the valve-seat member surrounding the valve needle provides at least a part of a guidance of the valve closure member.

15. The fuel injector as recited in claim 2, wherein the section of the valve-seat member surrounding the valve needle provides at least a part of a guidance of the valve closure member.

16. The fuel injector as recited in claim 2, wherein the cross-section of the at least one swirl channel is one of circular, elliptical, square, rectangular, triangular and trapezoid.

17. The fuel injector as recited in claim 2, wherein a plurality of spray-discharge orifices are provided.

18. The fuel injector as recited in claim 2, wherein the at least one swirl channel is produced by laser drilling, the drilling direction being substantially same as the flow direction of the fuel through the swirl channel.

* * * * *